US006782564B1

(12) United States Patent
Cheng

(10) Patent No.: US 6,782,564 B1
(45) Date of Patent: Aug. 31, 2004

(54) WATER-SAVING TOILET

(76) Inventor: Shiang-Sheng Cheng, P.O. Box 90, Tainan City (TW)

( * ) Notice: Subject to any disclaimer, the term of this patent is extended or adjusted under 35 U.S.C. 154(b) by 0 days.

(21) Appl. No.: 10/642,288

(22) Filed: Aug. 18, 2003

(51) Int. Cl.[7] ..... E03D 11/10
(52) U.S. Cl. ..... 4/434; 4/684
(58) Field of Search ..... 4/434, 252.2, 324, 4/326, 363, 364, 405, 411, 413, 684

(56) References Cited

U.S. PATENT DOCUMENTS 5,548,850 A * 8/1996 Geeham ..... 4/326
5,873,136 A * 2/1999 Geeham ..... 4/434

* cited by examiner

*Primary Examiner*—Gregory L. Huson
*Assistant Examiner*—Khoa Huynh

(57) ABSTRACT

A water-saving toilet includes a two-stage flush button, a water-storing area and a drain way formed in the interior of a toilet bowl and a valve control device positioned in the bowl and consisting of a valve, a valve cap, a drive rod, and an operating rod. The valve is positioned in water-storing area, having a passageway, with the valve cap deposited on the valve to close and open the valve. A push rod is connected under the valve cap, extending in the valve. In using, first, pressing the operating rod pushes up the valve cap to open the valve so urine with water remaining in the water-storing area flows into the drain way. Then press the flush button for a low volume of water to be flushed out in the bowl.

1 Claim, 4 Drawing Sheets

WATER-SAVING TOILET

BACKGROUND OF THE INVENTION

1. Field of the Invention

This invention relates to a water-saving toilet, particularly to one having a valve control device consisting of a valve, a valve cap, a drive rod and an operating rod. The valve of the valve control device is positioned on the bottom of a toilet bowl, and the valve cap is deposited on the valve to open and close the valve. The operating rod is positioned in the toilet bowl and extends out of the toilet bowl partially. When a user uses the toilet for urinating only, after finishing the action the person first presses down the operating rod to move the drive rod so as to push open the valve cap, and then urine mixed with the water remained in a water-storing area formed in the bottom of the bowl may flow down directly to a drain way in the bowl, and then the user next presses down the low volume stage of the press button to flush the low volume of water in the water tank in the toilet bowl and then drain out through the water storing area, the drain way in the bowl, and finally into the drain pipe.

2. Description of the Prior Art

It is a daily routine for people to relieve themselves, and flushing toilets are an indispensable fixture of people's homes in this civilized world, a very important invention for mankind to deal with most detectable and dirty waste. So a large volume of water should be used for flushing a toilet, and may account for 35% of the whole water used by a family. So how to save water quantity used by every home is quite an imperative problem, especially during the season of water shortfall.

So a two-stage flushing toilet has been made and is used widely nowadays, provided with a flush button for operating two different volumes of water to be flushed for urine and excrements separately so as to save water in case of urinating only. And the large volume of water may usually be 5.5 liters for flushing excrements and the small volume 4 liters for urine, so therefore 1.5 liters may be saved for one time of urinating. This saved water volume is not so much.

SUMMARY OF THE INVENTION

The purpose of the invention is to offer a water-saving toilet capable to use only a little volume of water as small as 1 liter for flushing one round of urinating and still keeping the toilet very clean after flushing.

One feature of the invention is a water-storing area formed in the bottom of a toilet bowl and a vertical through hole formed in the water-storing area.

Another feature of the invention is a valve control device positioned in the interior of the bowl for firstly let urine with the water remaining in the water-storing area to flow together down into a drain way of the bowl by opening a valve closed by a valve cap, and then pressing down the low volume stage of the flushing button is pressed to flush the low volume, say 1 liter, in the bowl and clean it and then drained out into a drain pipe. The valve control device consists of the valve, the valve cap, a drive rod and an operating rod. The valve is positioned in the through hole of the water-storing area, with the valve cap closed on the valve to open and close the valve by a push rod fitting in the passageway of the valve and possible to be pushed up by the drive rod, which is pushed by the operating rod having its outer end protruding out of the bowl to be pushed manually by a user. Then after finishing urinating the user first pushes down the operating rod to let the urine mixed with the water remaining in the water-storing area may flow down in the drain way. Then the low volume of water of 1 liter is to be flushed out of water tank into the bowl to clean completely its interior, saving water used in one round of urinating.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
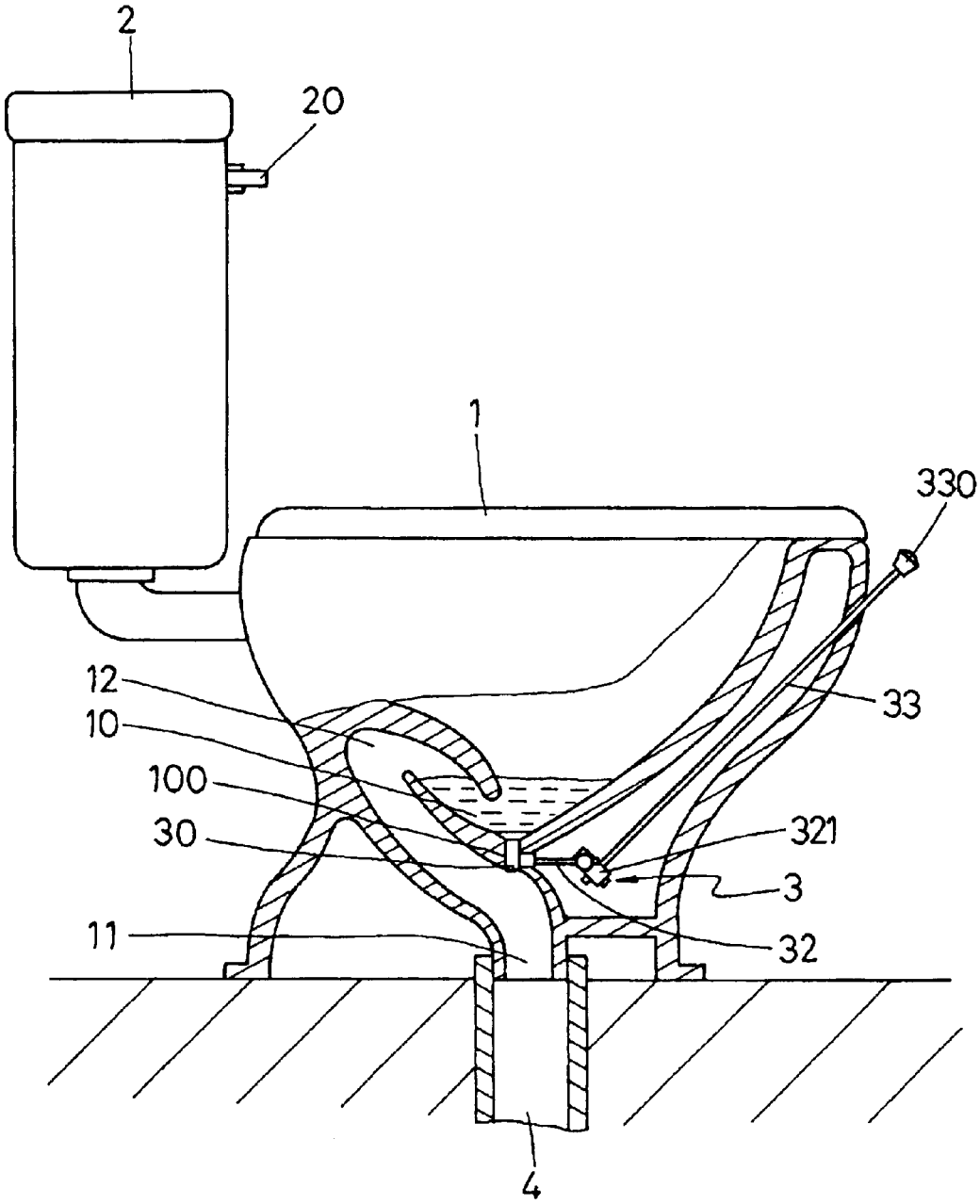
FIG. 1 is a cross-sectional view of a water-saving toilet in the present invention.
Figure 2:
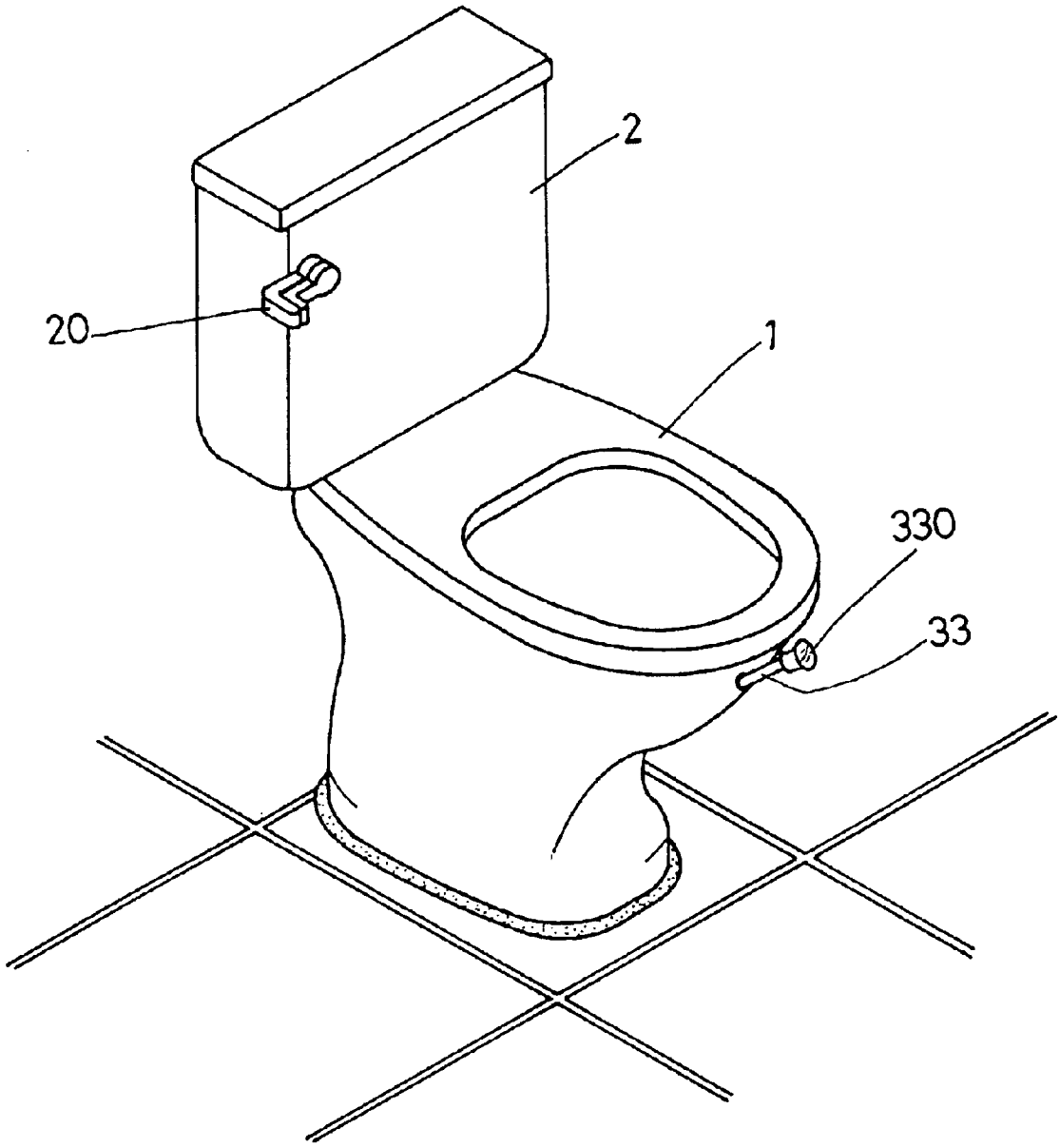
FIG. 2 is a perspective view of the water-saving toilet in the present invention.
Figure 3:
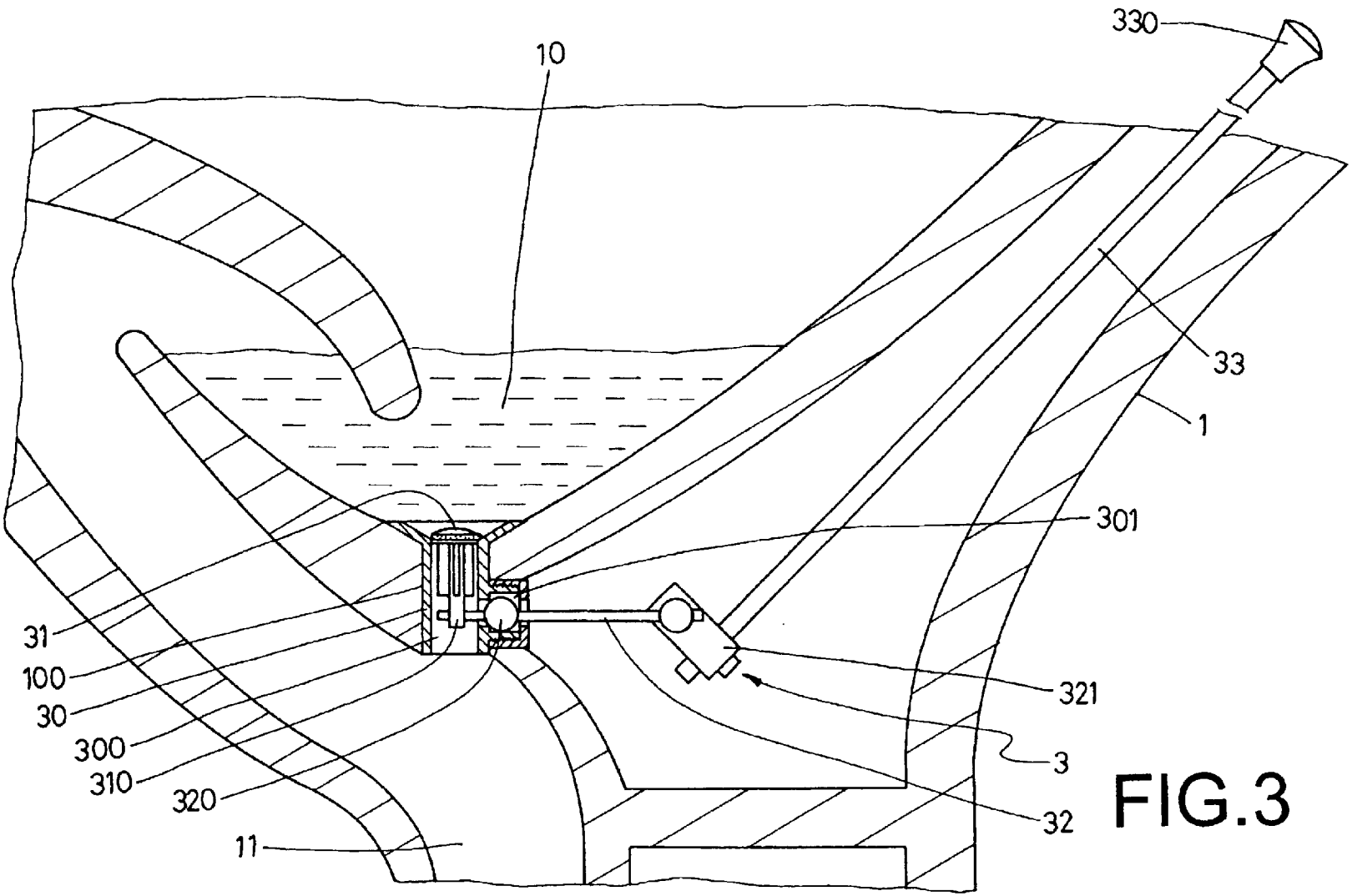
FIG. 3 is a magnified cross-sectional view of a valve control device fixed in the water-saving toilet in the present invention; and, FIG. 4 is a magnified cross-sectional view of using the valve control device in the present invention.
Figure 4:
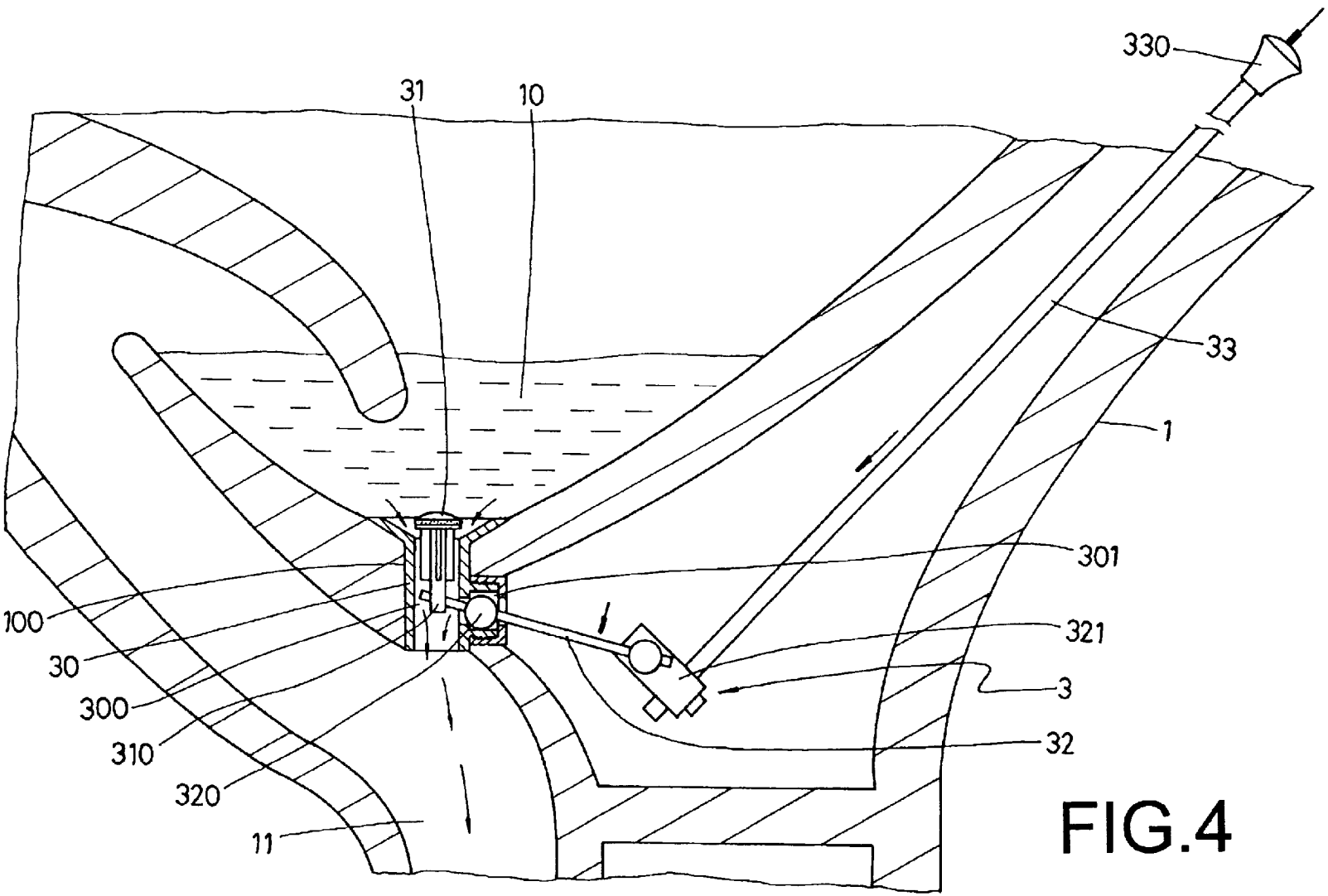

A preferred embodiment of a water-saving toilet in the present invention, as shown in FIGS. 1, 2 and 3, includes a toilet bowl 1, a water tank 2, a two-stage flush button 20 for flushing two kinds of water volumes, a water storing area 10 formed in the bottom of the toilet bowl 1, a bent passageway 12 formed behind the water storing area 10, a drain way 11 connected to the bent passageway 12, and a valve control device 3 positioned in the interior of the bowl 1.

The water storing area 10, the bent passageway 12 and the drain way 11 form an ordered drain route, and the drain way 11 is connected to a drainpipe 4 to guide waste material out. Further, the water storing area 10 is provided with a vertical through hole 100 in its bottom to communicate with the drain way 11.

The valve control device 3 consists of a valve 30, a valve cap 31, a drive rod 32 and an operating rod 33. The valve 30 is positioned in the through hole 100 of the water storing area 10, having a vertical passageway 300 for the water in the water storing area 10 to flow down in the drain way 11 without passing through the bent passageway 12.

The valve cap 31 is deposited on the valve 30 to open or close the valve 30, having its bottom connected to a push rod 310, which extends in the vertical passageway 300 of the valve 30. The drive rod 32 is pivotally connected to the push rod 310 with its left end, and a ball block 320 is fitted around an intermediate portion of drive rod 32 near the left end, received in a chamber 301 connected to the valve 30. The right end of the drive rod 32 is connected with one end of the connect rod 321, which has the other end pivotally connected to a lower end of the operating rod 33. Then the upper end of the operating rod 33 extends slantingly out of the bowl 1, fitted with a press button 330 for pushing down the operating rod 33 for indirectly pushing up the push rod 310 to open the valve 30 for urine mixed with the water remaining in the water-storing area to flow down through the vertical passageway 300 into the drain way 11.

In using, referring to FIGS. 1 to 4, in case a person used the toilet for urinating, after urinating the person first presses down the press button 330 to force the operating rod 33 move down, and then the operating rod 33 may push down the connect rod 321. Then the drive rod 32 may push the push rod 310 upward with the ball block 320 functioning as a fulcrum so that the valve cap 31 may be pushed upward to open the valve 30 to let the urine mixed with the water in the water-storing area 10 directly flow down through the vertical passageway 300 into the drain way 11. Next, the person selects to push the low volume of the two-stage press button 20 of the water tank 2 for flushing the low volume of water, 1 liter, to clean the water-storing area 10, the bent passageway 12 and the drain way 11 of the bowl. After flushing, the person pulls upward the operating rod 33 to move the connect rod 321, the drive rod 32, letting the ball block 320 functioning as a fulcrum to let the connect rod 321 move the push rod 310 down so the valve cap 31 closes up the valve 30, with some water remaining in the water-storing area 10, ready for next round of using.

If the save-water toilet in the invention is used for relieving excrements, the valve control device 3 is not necessary to use, and the large volume of the two-stage flush button 20 is used for flushing out the large volume of water, say 5 liters, from the water tank 2. Then the water with waste together is drained out of the drain way 11 into the drainpipe 4.

The valve control device 3 in the invention is used together with the low volume stage of the two-stage flush button. Then the low volume stage of the flush button of the water tank of the toilet can be adjusted as low as a liter, about 3 liters less than the normal low volume stage, 4 liters, of a conventional two-stage flushing toilet. Suppose that one person uses the toilet six times a day for urinating, with only 1 liter of water used, then the person can save 18 liters a day. Then we, the whole people, living in Taiwan could save water for 150 million tons a whole year, equivalent to the water volume of a large reservoir. Therefore, it is quite evident that the invention can practically save a large amount of water.

While the preferred embodiment of the invention has been described above, it will be recognized and understood that various modifications may be made therein and the appended claims are intended to cover all such modifications that may fall within the spirit and scope of the invention.

What is claimed is:

1. A water-saving toilet comprising a bowl, a water tank, a two-stage flush button for flushing out two different volumes of water from said water tank into said bowl, a water-storing area formed in a bottom of said bowl, a bent passageway formed behind said water-storing area communicating with a drain way, said drain way connected to a drain pipe for wastes to pass through;

said water-storing area having a vertical through hole in its bottom, a valve control device positioned in said bowl and consisting of a valve, a valve cap, a drive rod, and an operating rod; said valve positioned in said through hole of said water-storing area and having a vertical passageway, said vertical passageway connecting said water-storing area with said drain way, said valve cap deposited on said valve to close and open said valve, a push rod connected downward to said valve cap, said push rod extending in said vertical passageway of said valve, said push rod having its lower end pivotally connected to a left end of said drive rod, the right end of said drive rod connected with a lower end of said operating rod, said operating rod having its upper end protruding and exposing out of said bowl to be pushed down manually; and, said outer end of said operating rod exposing out of said bowl pressed down to force said drive rod move said push rod upward to push up the valve cap to open said valve normally closed in case of using said water-saving toilet, urine of a user mixed with the water in the water-storing area flowing down through said vertical passageway down to said drain way in case of said valve opened, said two-stage flush button pressed to flush out a low volume of water from said water tank into the interior of said bowl through the water-storing area, said bent passageway, said drain way and then into said drain pipe, said toilet cleaned with the low volume of water every time of flushing to save water volume after every round of urinating;

said drive rod of said valve control device having the right end connected with the left end of a connect rod, the right end of said connect rod connected to said operating rod; said drive rod having a ball block fitted around an intermediate portion near the left end, said ball block contained in a chamber connected to said valve, said ball block functioning as a fulcrum to let the left end of said drive rod move upward when said drive rod is moved down by said operating rod;

said operating rod having a press button fixed on the outer end for a user to manually press down; wherein said operating rod is protruded from a front upper end of the toilet.

* * * * *